US005996801A

United States Patent [19]

Tsu

[11] Patent Number: 5,996,801

[45] Date of Patent: Dec. 7, 1999

[54] PLASTIC T-SHIRT SHOPPING BAG PACK

[76] Inventor: Ronald Tsu, 5510 Grace Pl., Commerce, Calif. 90022

[21] Appl. No.: 09/186,785

[22] Filed: Nov. 4, 1998

Related U.S. Application Data

[60] Provisional application No. 60/065,881, Nov. 17, 1997.

[51] Int. Cl.[6] ..... B65D 33/10; B65D 33/00

[52] U.S. Cl. ..... 206/554; 383/9

[58] Field of Search ..... 206/554; 383/7, 383/9, 37; 493/193, 194, 195, 196

[56] References Cited

U.S. PATENT DOCUMENTS

| | | | |
|---|---|---|---|
| 5,307,935 | 5/1994 | Kemanjian | 206/554 |
| 5,335,788 | 8/1994 | Beasley et al. | 206/554 |
| 5,465,845 | 11/1995 | Norby et al. | 206/554 |
| 5,469,970 | 11/1995 | Li | 206/554 |
| 5,507,713 | 4/1996 | Glod, Sr. et al. | 493/194 |
| 5,562,580 | 10/1996 | Beasley et al. | 493/194 |
| 5,690,229 | 11/1997 | Piraneo et al. | 206/554 |

*Primary Examiner*—David T. Fidei
*Attorney, Agent, or Firm*—William H. Pavitt, Jr.; David A. Belasco; Mario A. Martella

[57] ABSTRACT

The invention encompasses a system by which a leading T-shirt bag may be removed from a rack while initiating the opening of the bag mouth of the next ensuing T-shirt bag, but without also simultaneously pulling out and opening in succession subsequent T-shirt bags of the pack. The invention accomplishes this by modifying the form of the conventional T-shirt bag by placing a second lower slightly offset horizontal tear slot below the horizontal slot on the center mounting tab by which the tab is held on the hook of the dispensing rack. The offset slot creates a narrow bridge on one end and a wider bridge on the other end of the slot. A glue spot is provided offset from the center toward the side with the narrower bridge, between the back of the forward bag and the front of the subsequent bag. When the leading T-shirt bag is filled and subsequently pulled away, the wider bridge first ruptures and the narrower bridge, coupled with the offset glue spot, works to pull open only the next bag. The narrower bridge and the glue spot connection are broken when the opened bag is later and removed.

1 Claim, 5 Drawing Sheets

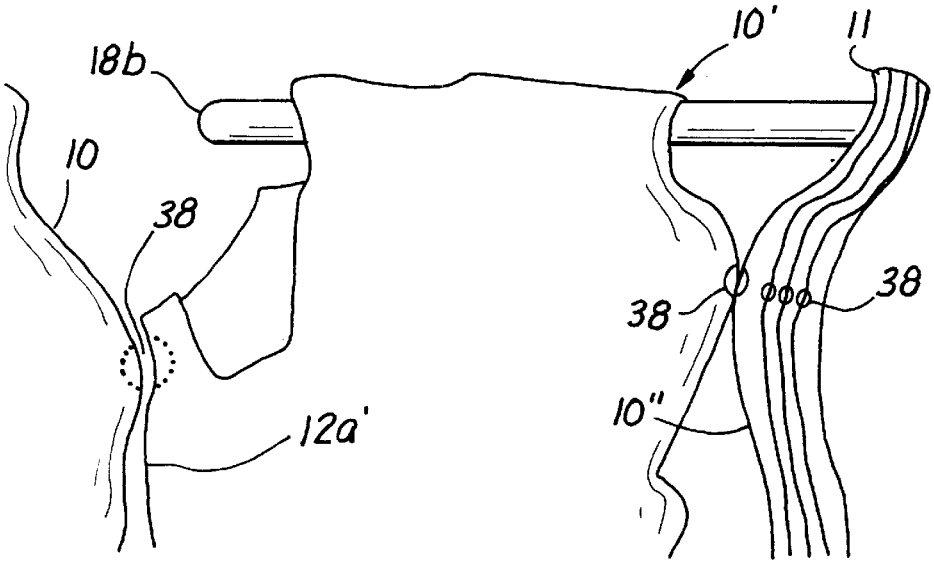
Fig. 5A
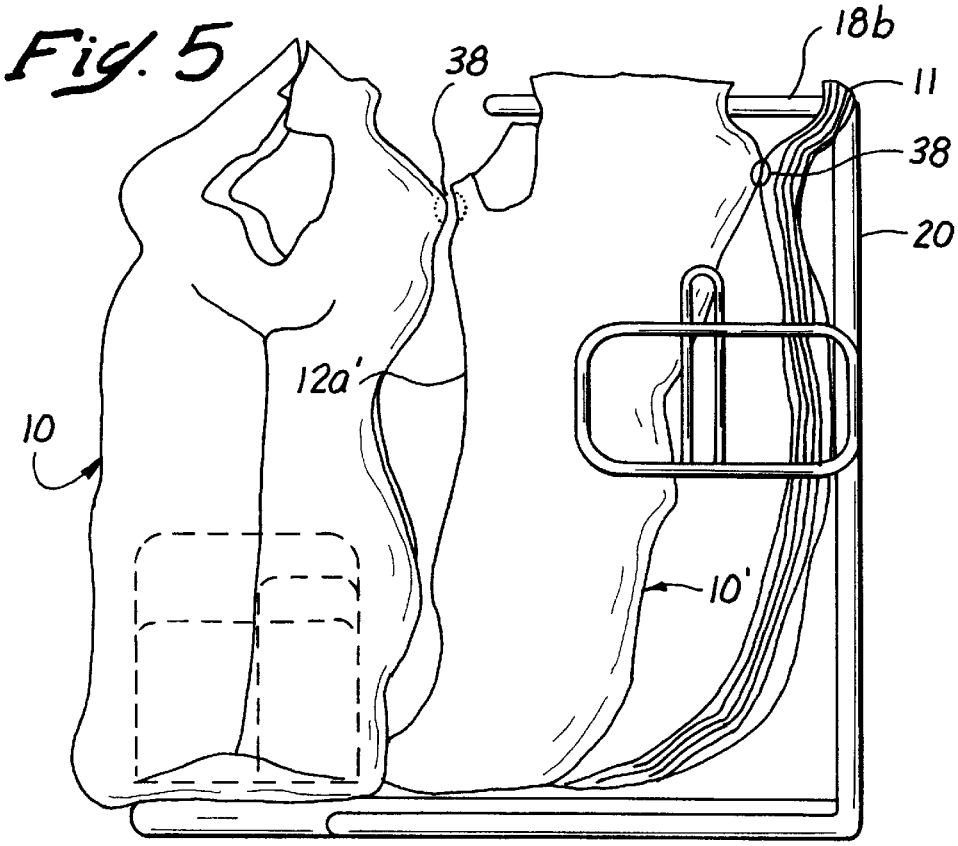

Fig. 6
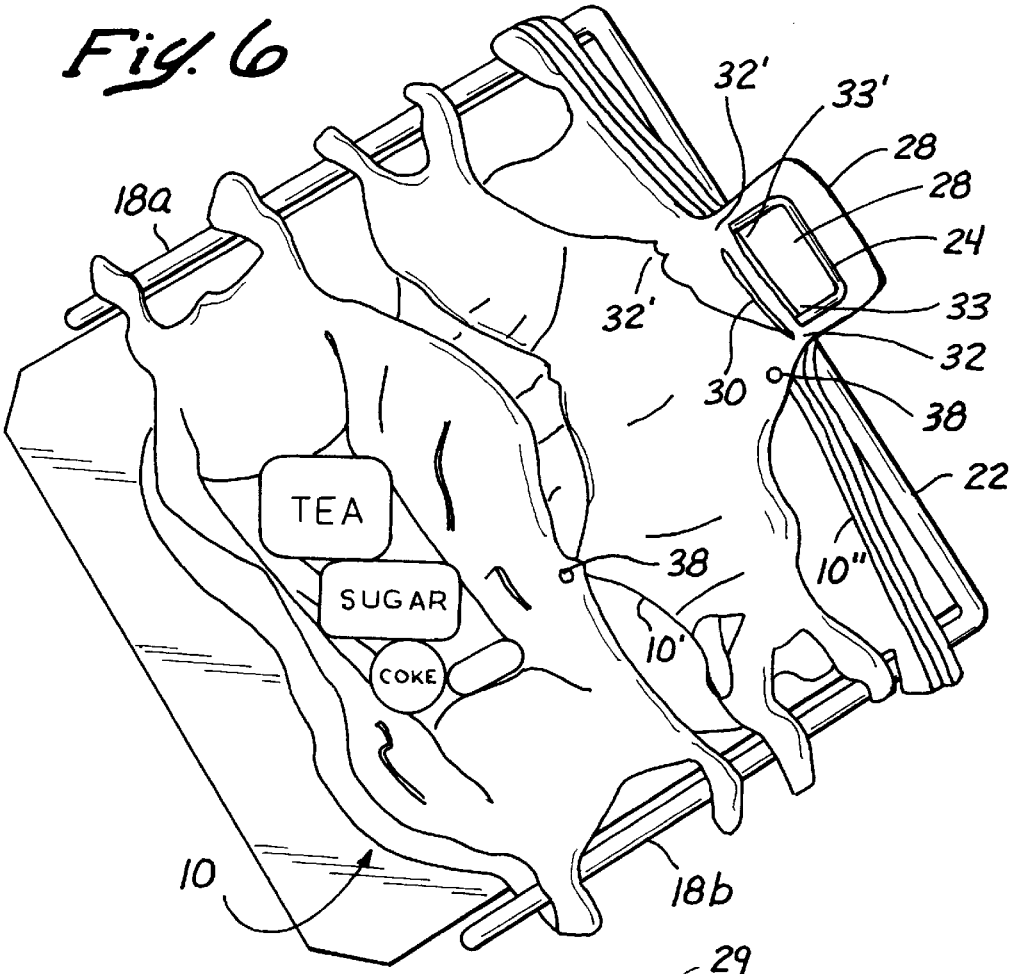
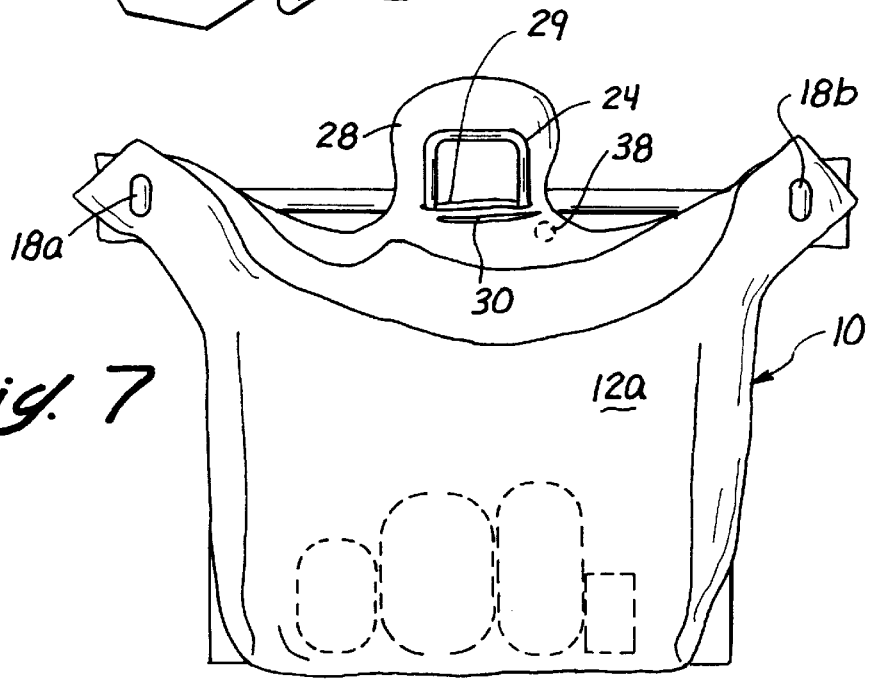
Fig. 7

PLASTIC T-SHIRT SHOPPING BAG PACK

PRIOR PROVISIONAL APPLICATION

This non-provisional application supercedes the prior provisional application, Ser. No. 60/065,881, filed Nov. 17, 1997, by the present and same inventor.

FIELD OF THE INVENTION

This invention relates to the field of plastic shopping bags and, particularly, to the T-shirt type bag which comes in packs to be mounted on projecting rod racks.

BACKGROUND OF THE INVENTION

Plastic shopping bags have become of universal use in grocery, department and other stores over the past several decades. Among the most popular type of plastic bags are those which are provided with orificed handles by which packs of such bags may be mounted on racks, comprising a base and a back structure with a pair of rods spaced from each other projecting forwardly. Such bags are commonly referred to as T-shirt bags since they resemble T-shirts of the tank type.

Numerous patents have been granted not only covering the combination of such bags with a rack, but also many variants of these bags. Among such variants are the types of bags which have central detachable portions extending upwardly from the bag mouths. Such portions may be transversely slotted to enable a pack of such bags to be mounted on an upwardly projecting hooking element also extending forwardly for a short distance from the center of the back support of the rack between the forwardly projecting rack rods. As each of such bags is pulled forwardly from the pack, at a certain point, the detachable central portion is torn from the bag wall defining the bag mouth, to remain on the central hooking element.

Initially each bag of the pack was separately pulled forward on the rack, filled by the store clerk and pulled off the forward ends of the rods, thereupon tearing the back wall from the central detachable portion projecting upwardly from the bag mouth and mounted on the central hooking element.

At some point in the development of various improved types of plastic bags, it was determined that if the back side of the back wall of the first bag were adhered by a glue spot to the front wall of the next ensuing bag of the bag pack, when the first bag was pulled forward on the rack, filled with articles and then removed from the rack, the front wall of the next ensuing bag would be drawn forward on the rack and readied for filling of the bag. This technique is illustrated in U.S. Pat. No. 5,307,935 which teaches placing the glue spot in the neck of the central upwardly projecting bag wall portion just below the detachment slots of the upwardly projecting portion on the bag wall defining the bag mouth. Other patents have shown glue spots centrally disposed below such bag neck.

The problem with these prior art glue spot bags is that either the glue spot may be so small that the back wall of the first bag becomes separated from the front wall of the ensuing bag before such back wall has pulled such front wall of the ensuing bag forward enough for filing; or alternatively, if the glue spot is too large, as the leading bag is pulled off the rack and the next ensuing bag is pulled forward for opening the bag mouth, a plurality of bags are also simultaneously pulled forward in a series so that each bag has to be separated by hand from the bag immediately following it. This result has frequently caused bag users to be dissatisfied with bag packs having glue spots.

What has been needed, therefore, is some system by which a leading bag may be removed from a rack while initiating the opening of the bag mouth of the next ensuing bag, but without also simultaneously pulling out and opening in succession subsequent bags of the pack.

BRIEF DESCRIPTION OF THE INVENTION

The present invention accomplishes the last stated objective by modifying the form of the conventional T-shirt bag to the extent of providing a shorter distance between one end of the slot or cut than the distance between the other end of the slot or cut, and the respective adjacent edge of the wall defining the detachable hook-receiving center portion, in combination with shifting the disposition of the glue spot from a vertical line bisecting the detachable center portion to a point in the upper bag wall offset from such line and beyond a line parallel to the bisecting line and approximately tangential to the edge of the detachable center portion having the shorter distance between it and the nearest end of the slot. Typically, the glue spot may be created by an automated hot melt glue system such as a "Nordson Corporation Model 3100 V" using H. B. Fuller hot melt adhesive such as "HL-7640-X-506 V" or "FHH-321."

By this combination, it will be found that, when the front wall of the first bag in the bag pack is pulled away from its rear wall to create an article receiving cavity, the wider bridge between slot end and the adjacent edge of the detachable center portion, first separates from its side of the detachable center portion followed by the rupture of the bridge at the other end of the slot, while simultaneously the portion of the rear wall having the glue spot initially draws with it the front wall of the next ensuing bag for a distance to open the bag before the glue spot loses its hold on the front wall of the ensuing bag and the leading bag separates from the next ensuing bag. In addition, because the glue spot is offset from the central line of the detachable center portion, and because of the sequential rupturing of the different size bridges between the slot ends, a desired insufficient pull is exerted to cause the front wall of subsequently aligned bags to be pulled forward before the bag being pulled by the first bag has been completely removed from the rack.

Thus, the first bag of the pack may be opened, filled and removed from the racked pack without being followed by a series of subsequent bags adhered together by centrally disposed glue spots.

It will be found then, that, when a bag after filling is removed from the rack, only the front wall of the next ensuing bag is drawn forward to open the bag without simultaneously causing a drawing forward any successive bags.

DESCRIPTION OF THE DRAWINGS

FIG. 5 is a side elevation showing the first bag completely removed from the rack, and the next bag opened up for filling.

FIG. 5A is an enlarged detail of the upper portion of the drawing shown in FIG. 5.

FIG. 6 is a top view looking down on a first filled bag pulled away from the second bag and the latter being opened.

FIG. 7 is a front elevation of what is shown in FIG. 6.

DESCRIPTION OF THE PREFERRED EMBODIMENT

Figure 1:
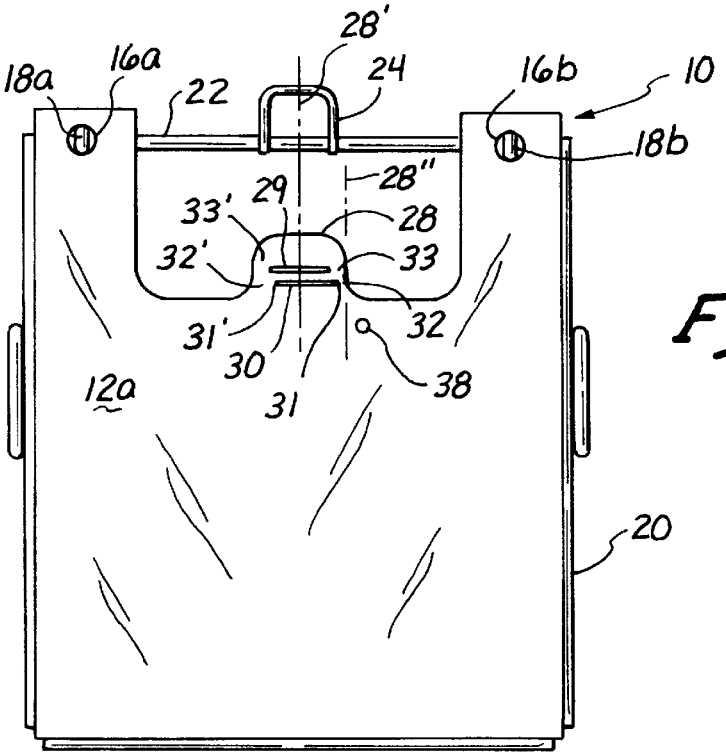
FIG. 1 of the drawings is a front elevation of a bag formed in accordance with the present invention and partially mounted on a conventional rack.
Figure 2:
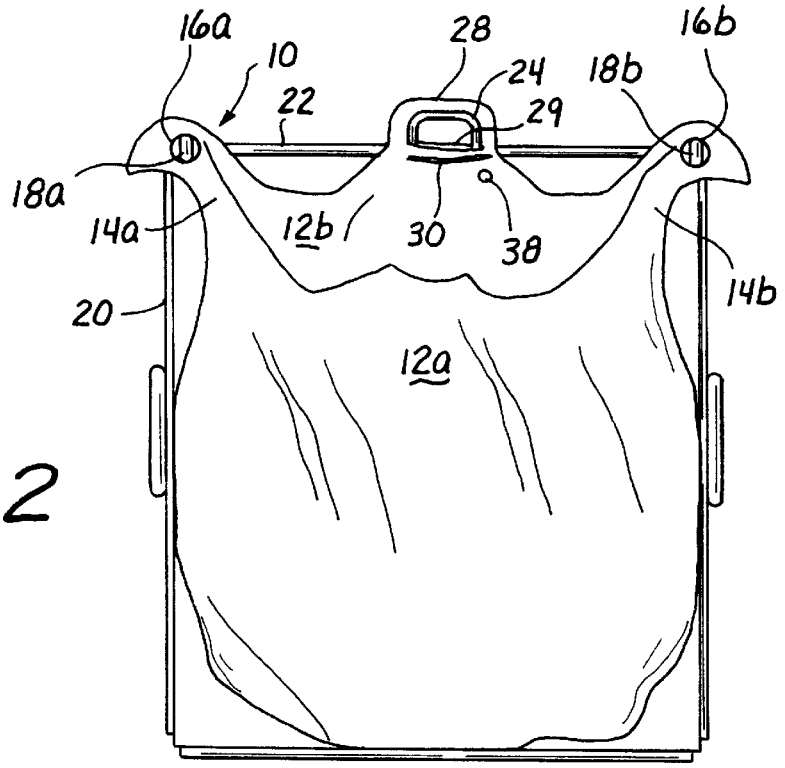
FIG. 2 is the front elevation similar to FIG. 1, but showing the front bag mounted on the rack and opened to receive articles.
Figure 3:
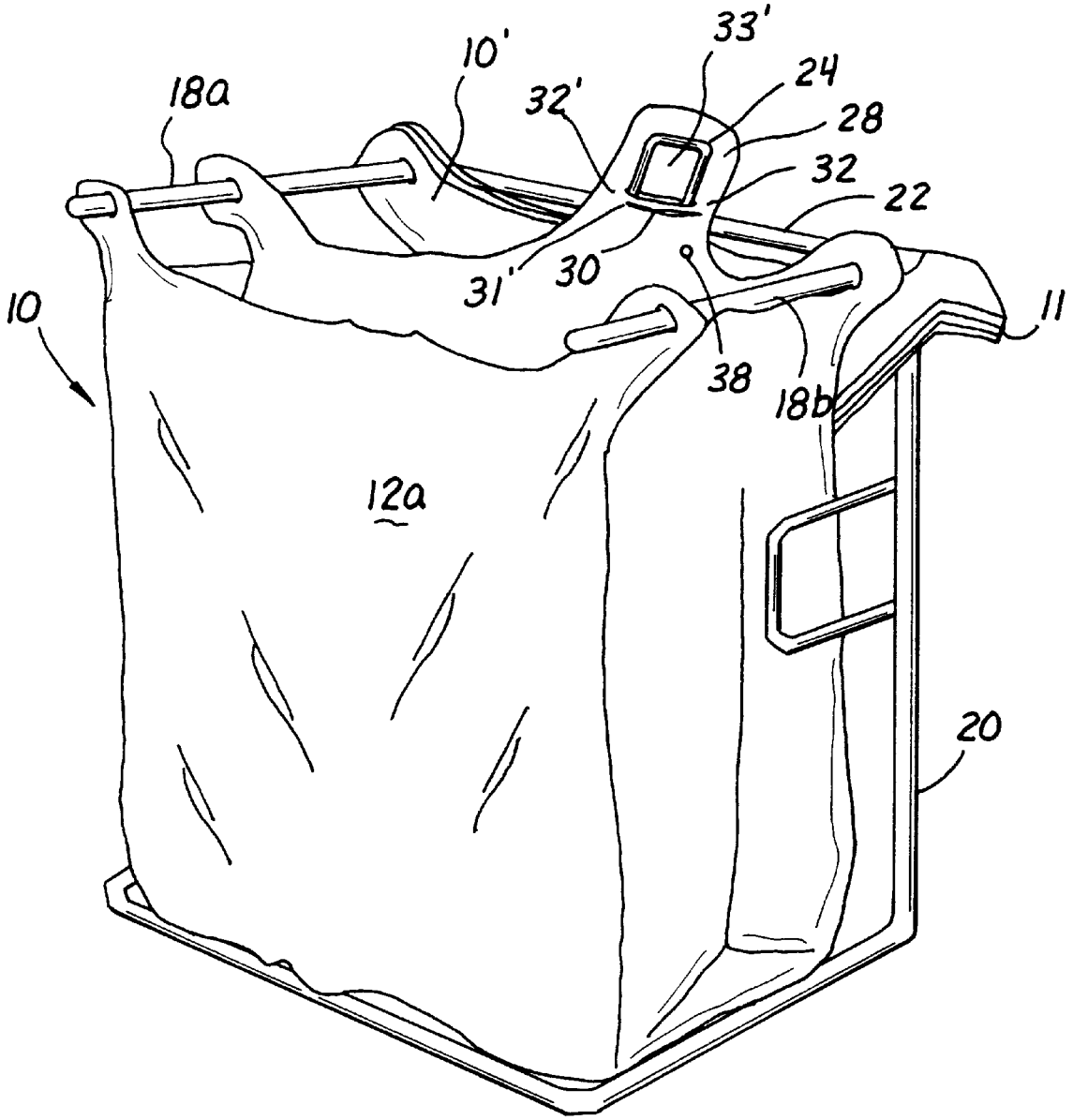
FIG. 3 is a perspective view of a portion of a pack of bags mounted on a rack as shown in FIG. 2.
Figure 4A:
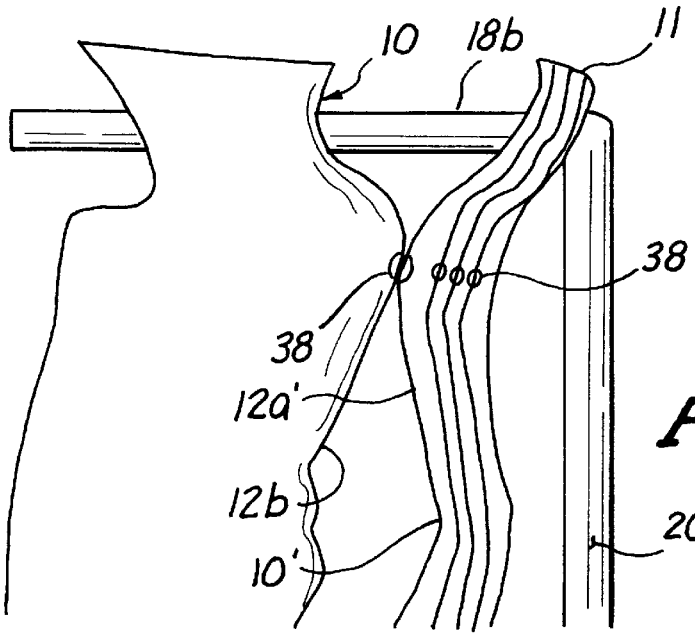
FIG. 4A is a side elevation of a portion of a pack of bags showing the first bag being removed from the rack.
Figure 4:
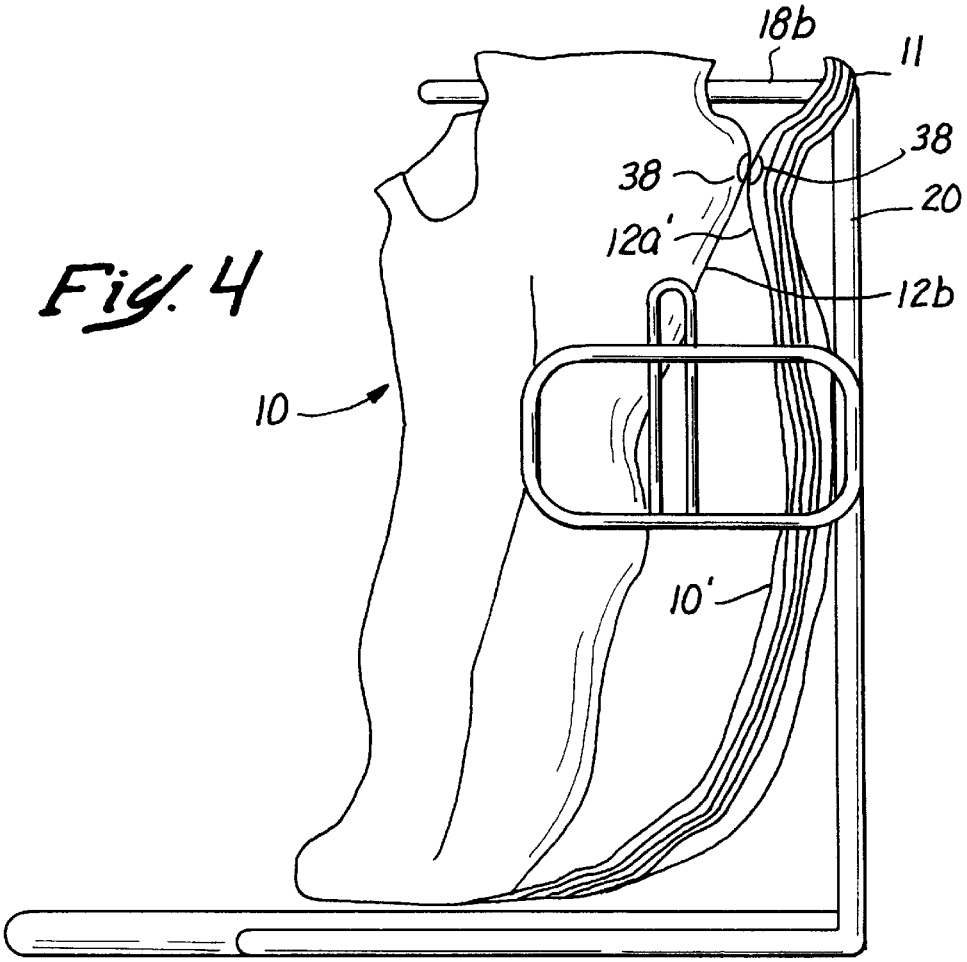
FIG. 4 is a side elevation showing a bag being opened for filling.

Referring to FIGS. 1 and 2 of the drawings, there is shown a T-shirt type bag 10 comprised of front and back walls 12*a* and 12*b*, the upper sides of which are formed as a pair of handles 14*a*, 14*b*, having mounting orifices 16*a*, 16*b* threaded over a pair of parallel rack rods 18*a*, 18*b*. A rack 20 may be provided with a backing frame 22 supporting an upwardly projectifig U-shaped hook-like element 24 on which the center 26 of the bags 10 may be mounted by lifting the detachable center portion 28 over the hook element 24 and passing the latter through a transverse slot 29 in each bag of the pack.

What has been described thus far is essentially the type of bag and mounting of the prior art. The present invention involves two modifications of prior art bags.

The first modification involves cutting a second lower slot 30 below the first upper slot 29, in such a way that the material or bridge 32 between one end 31 of the slot 30 and the portion 31 of the bag wall adjacent the slot end 31 and defining a part of the detachable center portion 28, is less in extent than the material or bridge 32' between slot end 31' and corresponding opposite portion 33' end of the bag wall adjacent the slot end 31'.

Coupled with this difference in the bridging from the respective ends 31, 31' of the slot 30, is an offset glue spot 38 between the rear wall 12*b* of the first bag and the front wall 12*a'* of the next ensuing bag, the glue spot 38 being offset from a vertical center line 28' through the detachable center portion 28 on the side where the lesser bridge 32 is disposed, and disposed in the vicinity of a parallel line tangential to the last described edge of the center portion 28.

FIGS. 3, 4, 4*a*, 5, and 5*a* illustrate the manner in which the first bag of the pack 11 may be opened up for filling. As soon as the first bag 10 is pulled forward, the glue spot 38 will begin to draw the next bag 10' forward on the rack rods (18*a* and 18*b*) and as it does so, almost simultaneously the bridge 32' between the end 31' of the slot 30 and the portion 33' of the bag wall adjacent the slot end 31' of the detachable center piece 28 will rupture. As the leading bag 10 is pulled further forward the opposite bridge 32 is ruptured. When the bag 10 has been fully opened, filled and its removal from the rack rods 18*a* and 18*b* is commenced, the glue spot holding the back wall 12*b* of the filled bag 10 and the front wall 12*a'* of the next ensuing bag 10' will also rupture.

As illustrated in FIGS. 6 and 7, the present invention enables a first bag 10 from a pack 11 to be opened and the bag 10 filled, and as it is removed, to draw forward the front wall 12*a'* of the next ensuing bag 10' to open it for filling. Because of the sequential rupturing of the bridges 32' and 32, and the small size of the glue spot 38, which itself is easily ruptured, as the front wall 12*a'* of the next ensuing bag 10' is pulled forward on the rack arms, it does not pull out a series of bags 10", 10" etc. from the pack 11 in the manner found to be done in the prior art.

I claim:

1. A stack of plastic T-shirt bags for mounting on a rack having an upwardly extending supported backing structure from which extend forwardly a pair of spaced apart parallel rods, between which is a centrally disposed hooking element also supported by the backing structure, each bag having a front and back wall secured together along their side, bottom and top edges, the joined top edges being centrally cut out to provide a bag mouth defined laterally by a pair of handles, and further defined by a pair of bottom edges extending between the handles, the inner central portion of the last said bottom edges having upwardly extending centrally disposed detachable projections, said projections having upward and side edges, upper transverse registering slots extending between, but spaced from, the projections' side edges, for mounting on the centrally disposed hooking element of the rack, and parallel lower registering slots having first and second ends, said lower slots also extending between the projections' side edges, the first end of each of the lower slots being more proximate to the adjacent side edge of the detachable projection than the second side edge is to its adjacent side edge of said projection; and the back wall of each bag being lightly adhered to the front wall of the next ensuing bag only at a spot offset from an imaginary vertical line extending centrally through the projection and disposed adjacent a parallel imaginary vertical line extending tangentially to the side edge of the projection most proximate to the first end of the lower slot;

whereby, when the leading bag of the stack is pulled forwardly on the rods of the rack to open said leading bag, the second end of each lower slot of its detachable projections is initially ruptured, and the front wall of the next ensuing bag of the stack is opened and pulled forward on the rack rods until adherence of the glue spot between the back wall of the leading bag and the front wall of the next ensuing bag is ruptured, immediately following which the area between the first end of each bottom slot and its most proximate edge of the projection of the leading bag is also ruptured;

thereby the subsequent ensuing bags are not simultaneously pulled forward as each leading bag is removed from the rack.

* * * * *